US006856288B2

(12) United States Patent
Apostolos et al.

(10) Patent No.: US 6,856,288 B2
(45) Date of Patent: Feb. 15, 2005

(54) FERRITE LOADED MEANDER LINE LOADED ANTENNA

(75) Inventors: John T. Apostolos, Merrimack, NH (US); Frank M. Caimi, Vero Beach, FL (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/424,375

(22) Filed: Apr. 28, 2003

(65) Prior Publication Data

US 2004/0212541 A1 Oct. 28, 2004

(51) Int. Cl.[7] ..... H01Q 1/38
(52) U.S. Cl. ..... 343/700 MS; 343/744; 343/895
(58) Field of Search ..... 343/700 MS, 702, 343/744, 745, 895

(56) References Cited

U.S. PATENT DOCUMENTS 4,201,989 A * 5/1980 Czerwinski ..... 343/715
5,484,765 A * 1/1996 Dionne et al. ..... 505/210
5,790,080 A 8/1998 Apostolos
6,313,716 B1 11/2001 Apostolos
6,323,814 B1 11/2001 Apostolos
6,373,440 B2 4/2002 Apostolos
6,373,446 B2 4/2002 Apostolos
6,404,391 B1 6/2002 Apostolos
6,480,158 B2 11/2002 Apostolos
6,492,953 B2 12/2002 Apostolos
2002/0118142 A1 * 8/2002 Wang ..... 343/895

* cited by examiner

*Primary Examiner*—Shih-Chao Chen
(74) *Attorney, Agent, or Firm*—Robert K. Tendler; Daniel J. Long

(57) ABSTRACT

A meander line loaded antenna is provided with a ferrite donut surrounding a portion of the meander line so as to effectively lower the operating range of the meander line loaded antenna by as much as 30%. At the lower frequencies the ferrite material introduces a minimal loss of 2 to 3 dB, whereas at the higher frequency range very little current passes through the meander line thus eliminating any effect of the ferrite on antenna performance. The utilization of the ferrite surrounding a meander line element permits the use of the miniaturized antenna and size for size reduces the low frequency cut off of the antenna.

12 Claims, 5 Drawing Sheets

CONVENTIONAL 30 MHz – 200 MHz

FERRITE LOADED MEANDER LINE LOADED ANTENNA

FIELD OF INVENTION

This invention relates to meander line loaded antennas and more particularly to the use of ferrite to reduce the low frequency cut off of the antenna.

BACKGROUND OF THE INVENTION

Whether the antenna is a capacitive feed type meander line loaded antenna or a standard meander line loaded antenna, these antennas are characterized by their small size and their wide band performance.

Meander line loaded antennas are described in U.S. Pat. No. 5,790,080 issued to John T. Apostolos on Aug. 4, 1998 and incorporated herein by reference. The purpose of the meander line is to increase the effective length of the antenna such that compact antennas may be designed for use, for instance, in cellular phones where real estate for the antenna is limited or in military applications where it is important to be able to provide a compact antenna for surveillance and communications in which the desired frequency range is 30 MHz to 200 MHz.

For cellular applications with the decrease in size of wireless handsets, it is only with difficultly that one can design an antenna which will fit within the margins of the case of the wireless handset and still be useable in dual or trimode phones which span the 830 MHz and the 1.7 and 1.9 Mz bands. Now that GPS receivers are sometimes included in wireless handsets it is important that the antenna also be able to receive the GPS frequency of 1.575 GHz.

As illustrated in U.S. Pat. No. 6,323,814 issued to John T. Apostolos on Nov. 27, 2001 and incorporated herein by reference, an improvement over Apostolos' original patent includes a wideband version in which the meander line loaded antenna has a wide instantaneous bandwidth. In this particular antenna the feed to the antenna is through a meander line coupled between the signal source and a plannar conductor extending orthogonally from the ground plane for the antenna. This configuration offers an instantaneous bandwidth of 7:1 and has been implemented in a so-called quadrature arrangement in which there are two pairs of meander line antennas arranged in opposition. The opposed pairs are orthogonally arranged to enable circular polarization.

As described in this latter patent, the meander line is connected in series between a signal source and a plannar top conductor which is spaced from the ground plane such that the signal from the meander line is directly connected to the top plate. The result for such a feed for the meander line loaded antenna is that the low frequency cut-off of the antenna is determined by the fact that the meander line loaded antenna reactance with a shorted meander line is positive at the lower frequencies, which when added to the meander line and distributed capacity reactance results in a high VSWR at frequencies, in one embodiment, below 860 MHz, thus limiting its usefulness in the cellular band which is centered around 830 MHz.

For military applications, while antennas have been designed to operate between 50 MHz and 200 MHz it is important to lower the low frequency cut off to 30 MHz and still maintain the small size of the antenna. It is noted that in this type of antenna the drive is fed through the meander line and then to the top plate. Moreover, a quadrature arrangement is possible with this meander line design and is desirable when the antenna is mounted to the roof of a truck cab because of the circular polarization provided by the quadrature design.

While capacitive feed meander line antennas have been effective in lowering the low frequency cut off of meander line loaded antennas, there is still a need to operate at even lower frequencies without enlarging the antenna. Whether utilizing a conventional meander line loaded antenna which has an ultra wide bandwidth, or when using a capacitively coupled meander line loaded antenna which in turn has a lowered low frequency cut off, it is desirable to even further lower the low frequency cut off for such antennas, making possible an operating range down to, for instance, 30 MHz in an antennas whose range typically goes from 50 MHz to 200 MHz.

In short, while present techniques permit the lowering of the low frequency cut off of such antenna systems, it is still desirable to have these antennas be able to operate at lower and lower frequencies, yet not increase their size.

SUMMARY OF THE INVENTION

Whether utilizing a conventional meander line loaded antenna such as described as above or one having a capacitive feed which even further lowers the low frequency cut off of a meander line loaded antenna, in the subject invention the low frequency cut off of these meander line loaded antennas may be lowered still further by as much as 30% by surrounding one of the meander line loaded antenna elements with a ferrite core, usually in form of a toroidal donut. The effect of surrounding one of the elements with a toroidal ferrite core is in effect to provide a series inductor which in turn effectively lengthens this particular element. The lengthening of this particular element in turn results in a lower frequency response such that the VSWR for the antenna at this lower frequency is identical to that at higher frequencies.

There is however an insertion loss at the low frequency end of these antennas, but the insertion loss is generally less than 2 to 3 dB. It is noted that the effect of the toroidal ferrite core is dependant upon current through the meander line. At the high frequency end the current through the meander line is virtually non-existent, meaning that the effect of the ferrite core is completely eliminated. The reason is that at the higher frequencies the antenna basically relies on the capacitance between the upper plate and the ground plane, leaving meander line as if it were not connected.

The result of utilizing the toroidal ferrite cores is either to lower the low frequency cut off of an existing meander line loaded antenna, or to permit even further shrinking of the meander line loaded antenna for the original frequency range intended.

The shrinking of the antenna is important especially when these antennas are utilized in hand held wireless devices or, for instance, when they are utilized in remotely piloted vehicles such as the Predator or other such unmanned vehicles used for surveillance. Size is important because it is critical that the antennas not create aerodynamic drag or in fact dictate an increase in the size of the vehicle.

For instance, when these vehicles are used for electronic surveillance, it is important to be able to cover a wide frequency band in order to detect signals of interest as the remotely piloted vehicle flies over a given area. These remotely piloted vehicles can in some instances be driven by electric motors and are hand launched at the battlefield. Thus the ability to micro miniaturize antennas operating as far down as 30 MHz is exceedingly important, especially in the electronic surveillance field.

In summary, a meander line loaded antenna is provided with a ferrite donut surrounding a meander line element so as to effectively lower the operating frequency of the meander line loaded antenna by as much as 30%. At the lower frequencies the ferrite material introduces a minimal loss of 2 to 3 dB, whereas at the higher frequency range very little current passes through the meander line, thus eliminating any effect of the ferrite on antenna performance. The utilization of a ferrite donut surrounding a meander line element permits the use of the miniaturized antenna at the lower and lower frequencies, and size for size reduces the low frequency cut off of the antenna.

BRIEF DESCRIPTION OF THE DRAWINGS

These and other features of the subject invention will be better understood in connection with the Detailed Description in conjunction with the Drawings, of which.

DETAILED DESCRIPTION

Figure 1A:
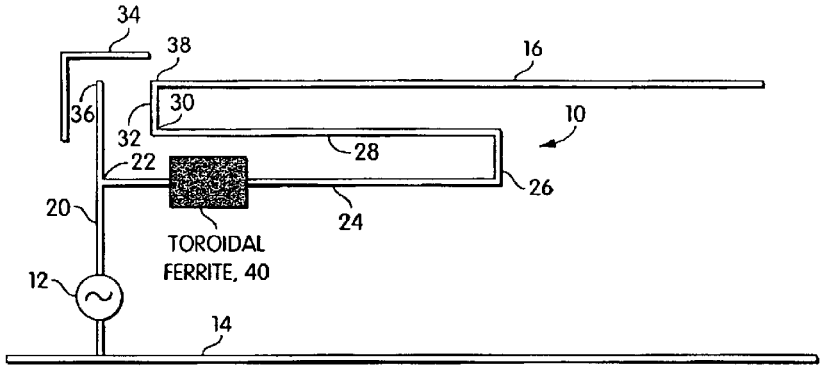
FIG. 1A is a diagrammatic representation of a standard meander line loaded antenna having a toroidal ferrite core surrounding one of the elements thereof.

Referring now to FIG. 1A, a meander line loaded antenna is shown having a meander 10 connected between a signal source 12 coupled to a ground plane 14 and a top plate 16 parallel to ground plate 14. The antenna has an upstanding feed conductor 20 coupled to one end 22 of a section 24 of meander line 10 which has an upstanding section 26 and a folded back section 28 which is in turn coupled to plate 16 at its distal end 30 by an upstanding portion 32. As is usual the meander line is composed of elements having different impedances which are effectively used to lengthen the circuit and thus reduce the overall size of the antenna. As shown in this Figure, a flap 34 is disposed over end 36 of feed 20 at end 38 of top plate 16.

The configuration shown in FIG. 1A comprises a wide bandwidth meander line loaded antenna which can be designed to have a low frequency cut off of 50 MHz and an high frequency cut off over 200 MHz.

Size-for-size in order to lower the low frequency cut off of the standard meander line loaded antenna of FIG. 1A, a toroidal ferrite donut 40 surrounds a portion of meander line element 24, the operation of which is to effectively lengthen that particular element from electrical point of view while not in any way altering the overall size of the structure.

Figure 1B:
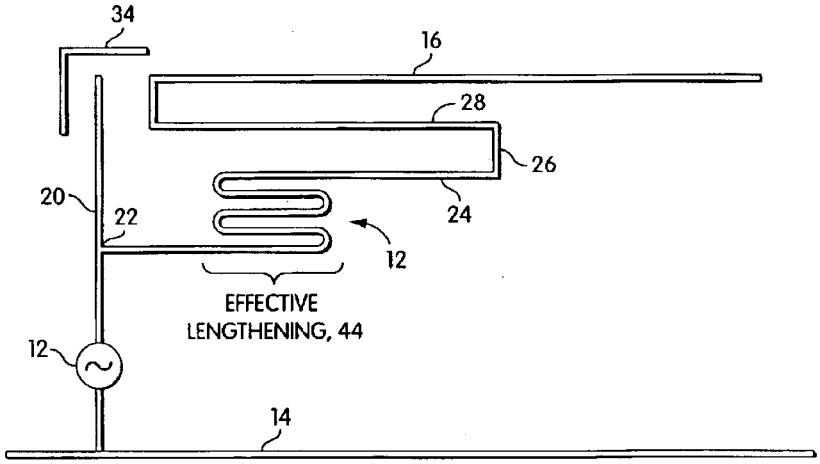
FIG. 1B is a diagrammatic illustration of the conventional meander line loaded antenna of FIG. 1A, illustrating the effective lengthening of one element of the meander line through the use of the toroidal ferrite core by effectively putting an inductor in series with the ferrite surround element.

Referring to FIG. 1B, in which like elements have like reference characteristics with respect to FIG. 1A, the utilization of the ferrite core in essence lengthens element 24 as illustrated by the serpentine line 42 such that the effective length 44 of this meander line element is increased, sometimes as much as 30%. The increase of this particular meander line segment or section contributes to the lowering of the low frequency cut off of the antenna.

Figure 2A:
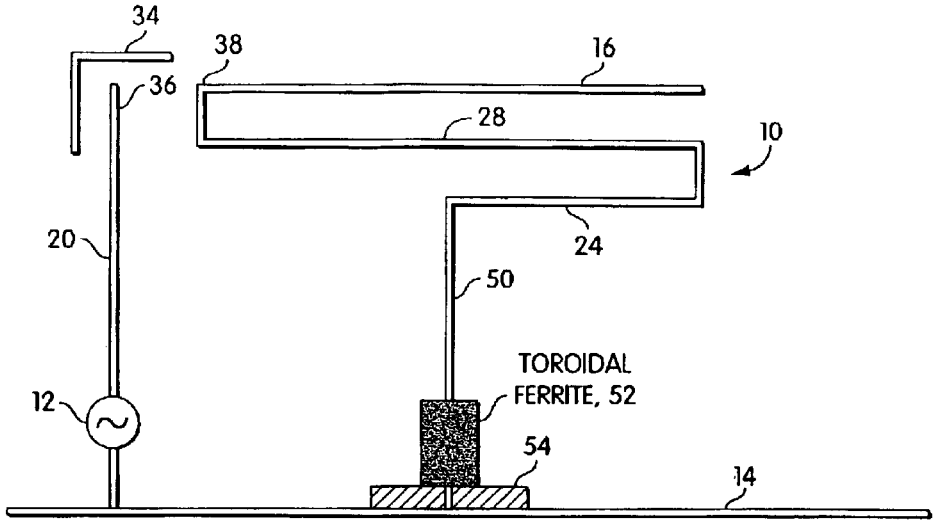
FIG. 2A is a diagrammatic illustration of one embodiment of a capacitively fed meander line loaded antenna having a toroidal ferrite core surrounding a downwardly directed portion of the meander line which is electrically connected to the ground plane.

Ferrite may also be utilized in a capacitive feed antenna such as the one shown diagrammatically in FIG. 2A. Here meander line 10 is feed capacitively by the capacitance between end 36 of feed 20 and end 38 of top plate 16. The capacitance feed for this antenna can result in significant lowering of the low frequency cut off of the antenna. However, if it is desired to even further lower the low frequency cut off of the capacitively fed antenna, meander line section 24 which is disposed downwardly as illustrated at 50 and is connected to ground plane 14 as illustrated is surrounded by a toroidal donut 52 which is spaced from or insulated from ground plate 14 by insulator 54.

Figure 2B:
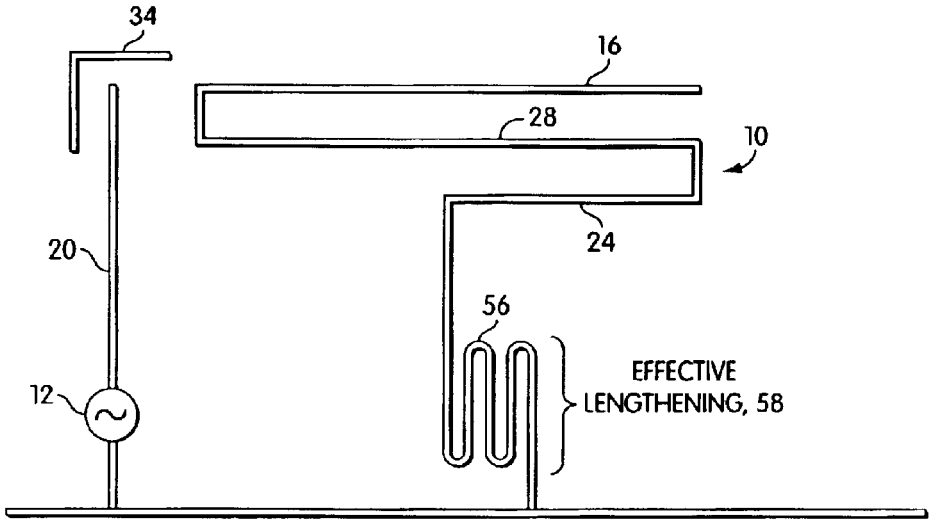
FIG. 2B is a diagrammatic illustration of the capacitively fed meander line loaded antenna of FIG. 2A illustrating the effective lengthening of the downwardly directed portion of the meander line by effectively introducing a series connect inductor in the element surrounded by ferrite.

Referring to FIG. 2B, in which like elements have like reference characteristics with respect to FIG. 2A, it can be seen that meander line segment is effectively lengthened as illustrated by the serpentine line 56, with the effective lengthening illustrated at 58.

Figure 3:
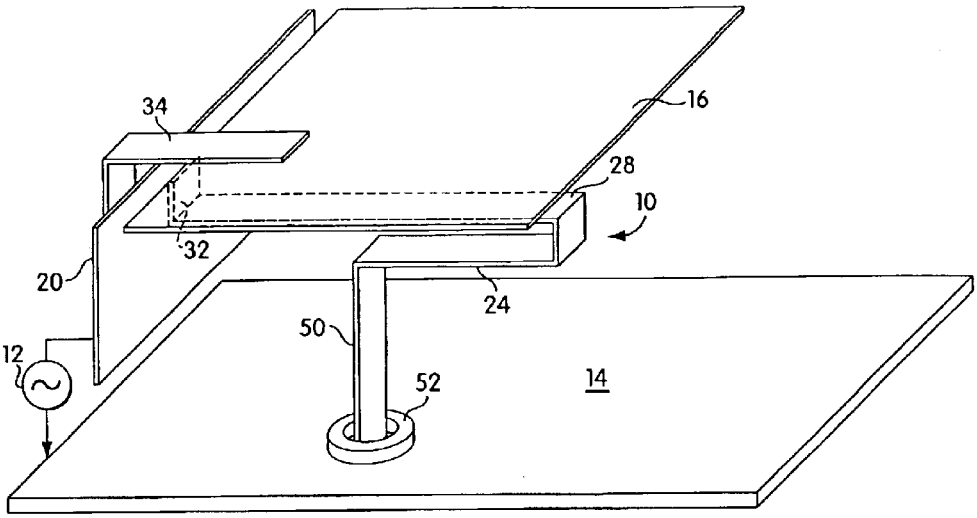
FIG. 3 is a perspective view of the capacitively fed meander line loaded antenna of FIG. 2A illustrating the position of the toroid about the downwardly projecting portion of the meander line.
Figure 4:
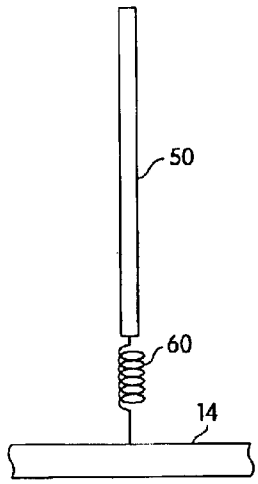
FIG. 4 is a schematic diagram of the effect of adding a toroidal ferrite core about the downwardly projecting element of the antenna of FIG. 3, indicating a series connected inductor as being the effect of adding the toroid.

Referring to FIG. 3, in perspective this capacitively fed meander line loaded antenna is shown with the sections of meander line 10 as illustrated. Here it can be seen that the toroidal ferrite donut 52 surrounds the downward projecting portion 50 of meander line element 24, with FIG. 4 showing electrically that portion of the meander line as having a downwardly directed portion 50 and an inductor 60 connected between portion 50 and ground plane 14.

Figure 5:
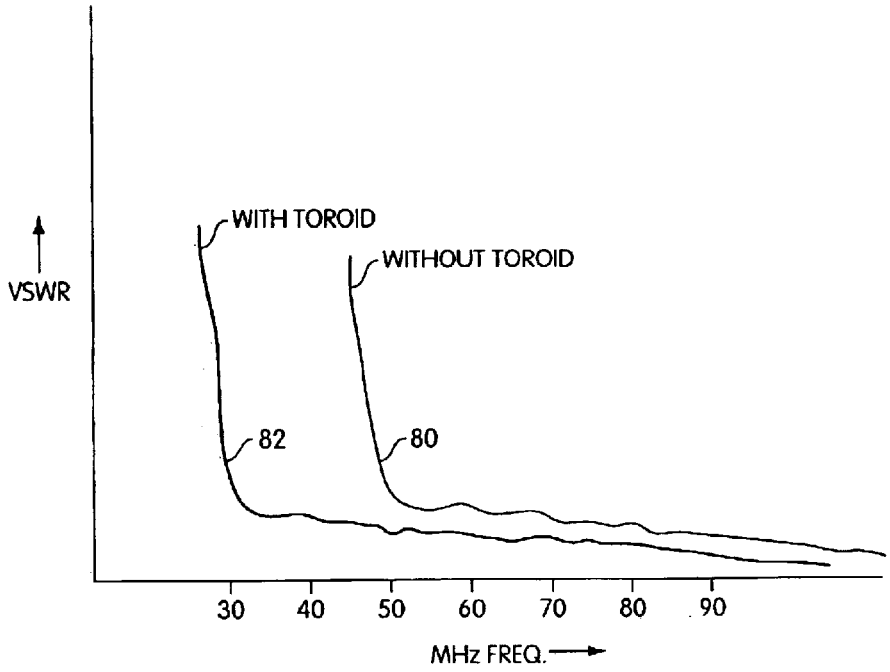
FIG. 5 is a graph showing VSWR versus frequency for an antenna without the toroid versus one with the toroid, showing that without the toroid the low frequency cut off is around 50 MHz, whereas with toroid the low frequency cut off is around 33 MHz.

The result in terms of VSWR, with and without the use of a toroid, is illustrated in FIG. 5. Here it can be seen that in a graph of VSWR versus frequency line 80 describes the VSWR of the antenna without a toroid, whereas line 82 describes the VSWR when utilizing the toroid.

It can be seen that the low frequency cut off of the antenna in one embodiment is above 50 MHz, whereas the low frequency cut off of the self-same antenna with the use of the toroid is approximately at 33 MHz.

Figure 6:
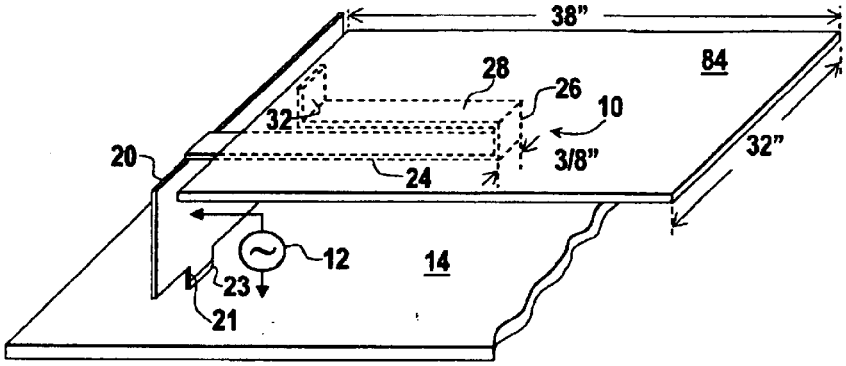
Fig. 6 (Prior Art)
FIG. 6 is a perspective view of a conventional meander line loaded antenna having a top plate which is 32" by 32", with a meander line segment being a $\frac{3}{8}^{th}$ inches wide; and, FIG. 7 is a diagrammatic illustration of the horizontally running segment of the meander line of FIG. 6 being provided with a toroidal donut of ferrite material which is ½" long with a ½" in inside diameter.

Referring to FIG. 6, a conventional meander line loaded antenna for use between 50 MHz and 200 MHz has a top plate 84 which is 32" by 32". Meander line 10 has width of ⅜" such that its sections 24, 26, 28 and 32 have this width. Also feed 20 has this same width, with feed 20 having an extending tab 21 and an insulating mounting member 23. The ground plane segment of the antenna 14 has at least this 32" by 32" footprint.

Figure 7:
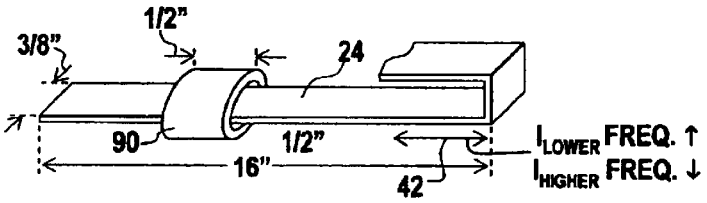

Referring to FIG. 7, a ferrite toroid 90 surrounds a portion of section 24.

In this embodiment, for a frequency range of 30–150 MHz, one uses a T-50 ferrite core with permeability of 6. The outer diameter is 0.5 inches, with the inner diameter being 0.3 inches and the height being 0.19 inches. Inserting the toroid around the meander line results in an inductance of 0.16 microhenry. This inductance is in series with the meander line. The reactance of the meander line at 50 MHz is about 60 ohms. This normally cancels out the antenna capacitive reactance at 50 MHz, which is −60 ohms. Adding the toroid increases the meander line reactance from 60 to 90. This lowers the minimum usable frequency from 50 MHz to 30 MHz since the antenna reactance at 30 MHz is −90 ohms.

One method for reducing the lowest frequency of operation from 50 MHz to 30 MHz is as follows:

Measure the reactance of the antenna at 30 MHz. In one case the reactance of the antenna is −90 ohms capacitive.

Measure the meander line reactance. In the above case, the meander line reactance is measured at +60 ohms inductive at 30 MHz. One therefore needs to add 30 ohms of inductive reactance to the meander line at 30 MHz. One then looks up in tables of toroid design as in the ARRL handbook for the right combination of size and permeability of the toroid. Assuming ½ turn, this is 0.16 microhenries. This yields an additional 30 ohms of inductive reactance. The above is how the dimensions and permeability of the toroid are determined.

Referring back to FIG. 7, it is noted that the antenna current as illustrated by double-ended arrow 92 goes up as the frequency of source 12 is decreased, thereby in essence activating the ferrite toroidal core. As the frequency at which the antenna is to operate is increased the amount of current in section 24 markedly decreases such that at, for instance, at the 200 MHz end of the band for this antenna there is virtually no current flowing through the toroid and its effect is minimal at best.

What can be seen is that through the utilization of ferrite in a toroidal form surrounding a meander line element, the element is effectively elongated by in effect placing an inductor in series with the element.

For a meander line loaded antenna which has multiple meander lines or multiple meander line sections, in order to lower the low frequency cut off of such an antenna, the toroidal donut is placed about that meander line section which corresponds to the longest element of the meander line. There is, however, no reason why the toroidal cannot be placed around any meander line section the length of which is to be extended, thus to provide great flexibility in the design of the meander line loaded antenna. Also, meander lines in general can be effectively lengthened through the use of the toroidal ferrite core in any application that a meander line might be used.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. In a meander line loaded antenna in which the meander line has a number of sections, a method for lowering the low frequency cut off of the antenna without affecting the high frequency cut off, comprising:

completely surrounding one of the meander line sections with ferrite, whereby the size of the antenna need not be increased to lower the low frequency cut off thereof.

2. The method of claim 1, wherein the ferrite is in a toroidal form.

3. The method of claim 1, wherein the antenna has a top plate and wherein the top plate is fed with a direct connection to the top plate.

4. The method of claim 1, wherein the antenna has a capacitively fed.

5. The method of claim 4, wherein the antenna has a top plate and wherein the capacitive feed for the antenna includes a conductor having an end spaced from an end of the top plate.

6. A method of electrically lengthening an element of a meander line comprising completely surrounding at least a portion of the element with ferrite.

7. The method of claim 6, wherein the addition of ferrite effectively produces an inductor in series with the element.

8. The method of claim 6, wherein the ferrite is in the form of a torus.

9. A wide bandwidth meander line loaded antenna having a reduced low frequency cut off, comprising:

a ground plane;

a top plate;

a meander line having segments and located between the ground plane and top plate; and, ferrite disposed completely about a segment of the meander line, thus to increase the effective electrical length thereof.

10. The antenna of claim 9, wherein said top plate is direct fed.

11. The antenna of claim 9, wherein said top plate is capacitively fed.

12. The antenna of claim 9, wherein said meander line has a number of different elements, said ferrite surrounding that element which is electrically the longest.

* * * * *